US005586188A

United States Patent [19]

Renggli et al.

[11] Patent Number: 5,586,188

[45] Date of Patent: Dec. 17, 1996

[54] HEARING AID

[75] Inventors: Peter Renggli, Köniz; Grégoire Iten, Düdingen; Monika Speck, Spiegel; Jurg Clavadetscher, Ortschwaben, all of Switzerland

[73] Assignee: Ascom Audiosys AG, Flamatt, Switzerland

[21] Appl. No.: 434,400

[22] Filed: May 3, 1995

[30] Foreign Application Priority Data

May 10, 1994 [CH] Switzerland ..... 1457/94

[51] Int. Cl.[6] ..... H04R 25/00

[52] U.S. Cl. ..... 381/69.2; 381/68.6; 381/68

[58] Field of Search ..... 381/68, 68.2, 68.4, 381/68.6, 69, 69.2, 68.7; 439/500, 504; 429/96, 97, 100

[56] References Cited

U.S. PATENT DOCUMENTS

| | | | |
|---|---|---|---|
| 3,588,384 | 6/1971 | Negley | 381/68.5 |
| 5,109,424 | 4/1992 | Andre et al. | 381/159 |
| 5,188,540 | 2/1993 | Haertl et al. | 381/68.2 |
| 5,500,901 | 3/1996 | Geraci et al. | 381/68.2 |

*Primary Examiner*—Sinh Tran

*Attorney, Agent, or Firm*—Watson Cole Stevens Davis, P.L.L.C.

[57] ABSTRACT

The hearing aid with a faceplate is charactrized in that the axle for the mounting of a part which can be pivoted outwards consists of an electrically conductive material and serves as connection between mentioned part and the electronics of the apparatus.

2 Claims, 1 Drawing Sheet

HEARING AID

BACKGROUND OF THE INVENTION

1. Field of the Invention

The present invention relates to a hearing aid including a casing and a covering plate foreseen at the casing, which covering plate has an opening and an axle located in the opening, and including an outwardly pivotable part fitting into the opening and having an electrical input plug and contact pieces for a connection to electronics of the hearing aid.

2. Description of the Prior Art

In order to occupy still less space commensurate with the present state of miniaturization, there has arisen the desire to optimize the design still further without having to suffer a larger structural expenditure.

SUMMARY OF THE INVENTION

It is, therefore, a general object of the invention to provide a hearing aid which occupies still less space without suffering from a large structural expenditure.

A further object is to provide a hearing aid of the kind set forth above and in which the axle comprises of an electrically conductive material.

BRIEF DESCRIPTION OF THE DRAWINGS

The present invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
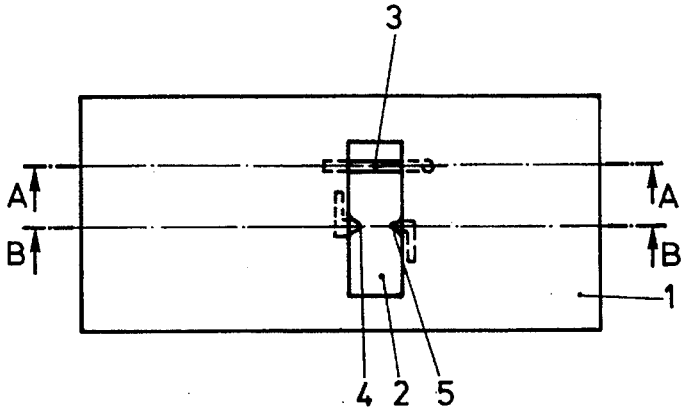
FIG. 1 is a schematic top plan view of a covering plate mounted onto a casing of a hearing aid according to the invention.
Figure 2:
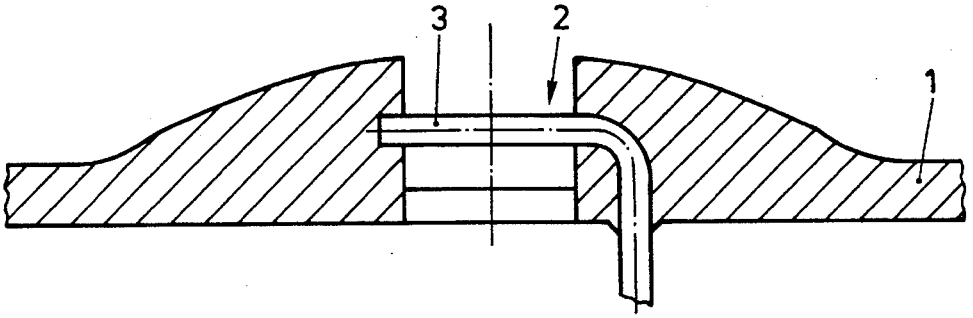
FIG. 2 is a sectional view, at an enlarged scale, taken substantially along line A—A of FIG. 1.
Figure 3:
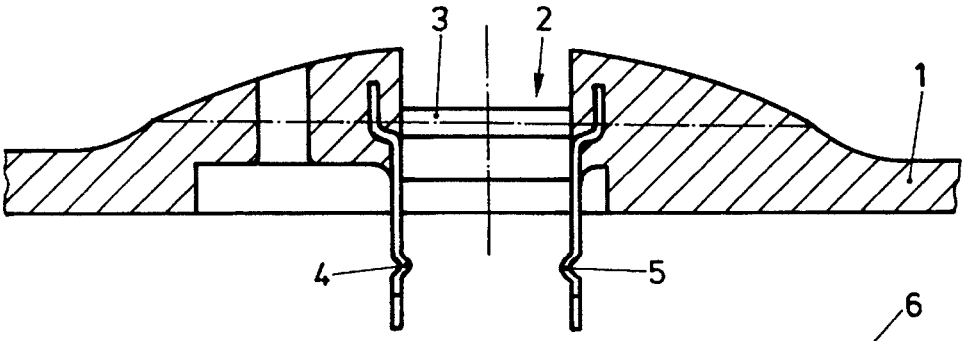
FIG. 3 is a sectional view, at an enlarged scale, taken substantially along line B—B of FIG. 1.

The covering plate 1 illustrated in FIG. 1 is provided at the housing (not illustrated) of a hearing aid. An opening 2 is provided in the covering plate 1 (also called faceplate), into which opening a part 6 shown in FIG. 4 may be inserted. This part can be set onto an axle 3 and can be pivoted outwardly about the axle (in a way as a cover which can be pivoted outwardly).

The part which can be pivoted outwardly may be designed e.g. as an adapter with an input plug for a programming or audio cable (e.g. connector to a telephone apparatus) such as a battery case with a battery held therein.

The part supported to pivot on the axle 3 can be detached from the axle, i.e. may be removable and exchanged for another part.

Contact pieces 4,5 are provided in the covering plate at the lateral limiting surfaces of the opening 2, which communicate with the electronics of the apparatus. At the other side, the part which can be pivoted outwardly and can be fitted into the opening is provided with an electrical input plug 7 with contact pieces 8,9, which are provided to make an electrical communication with the contact pieces 4,5 when in the operative position in order to thereby form a communication between an external component (e.g. programming apparatuses) which is coupled via the plug in the part which can be pivoted outwardly and the electronics of the apparatus.

According to the present invention, because of the confined conditions in such miniaturized apparatuses, the axle 3 for the part which can be pivoted outwardly is electrically conductive (of metal) and is utilized as one of the electrical connecting parts. For this reason the metal axle 3 is connected at the one end to the electronics of the apparatus and at the other end it forms a counter contact for contact piece at the part which can be pivoted outwardly and is set into the opening 2.

The design is specifically suitable for the programming of hearing aids in that a so called programing adapter with input plug is set into the opening 2 of the covering plate.

Figure 4:
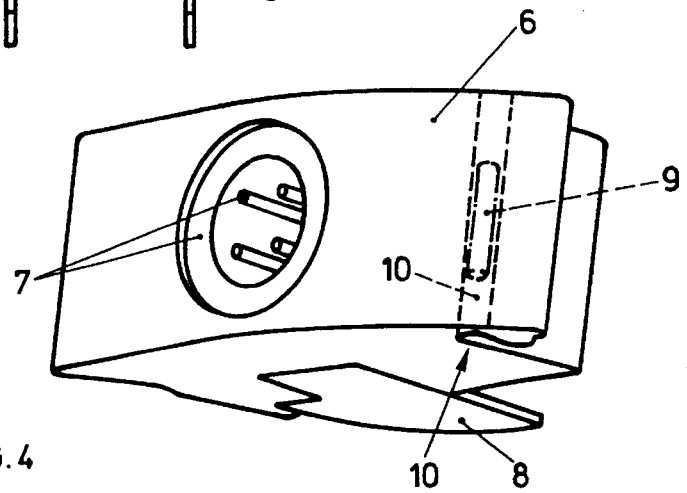
FIG. 4 is a perspective view of a programming adapter of the invention, structured to be inserted into the opening of the covering plate.

FIG. 4 illustrates a programming adapter 6 with input plugs 7 and contact pieces 8,9. The contact piece 9 is set into the groove 10 via which the adapter can be set onto the electrically conducting axle 3.

What is claimed is:

1. A heading aid having a housing containing internal electronics, a coveting plate at said housing, said covering plate having an opening for the reception of an outwardly pivotable adapter having an electrical input plug for a programming or audio cable, a first electrical contact piece at said opening connected to said internal electronics, a second electrical contact piece on said adapter in contact engagement with said first contact piece at said opening upon insertion of said adapter into said opening, an axle of electrically conducting material mounted in said covering plate, one end of said axle spanning said opening to provide a pivot engaged by a groove provided in said adapter to facilitate pivotable movement thereof into and out of said opening, another end of said axle being connected to said internal electronics, and said adapter having a third electrical contact piece at said groove for contacting said one end of said axle upon said pivotable movement, wherein fewer electrically connecting parts are required for said adapter and said plate.

2. The hearing aid of claim 1, wherein said adapter is removably mounted onto said one end of said axle.

* * * * *